United States Patent [19]

Herweyer et al.

[11] Patent Number: 4,977,885

[45] Date of Patent: Dec. 18, 1990

[54] HOT WATER HEATING SYSTEM WITH SELECTIVE BYPASS

[76] Inventors: Eleanor B. Herweyer; Elliott E. Herweyer, both of P.O. Box 257, Goochland, Va. 23063

[21] Appl. No.: 466,600

[22] Filed: Jan. 17, 1990

Related U.S. Application Data

[63] Continuation-in-part of Ser. No. 377,093, Jul. 10, 1989, abandoned.

[51] Int. Cl.[5] ..... F24H 1/00

[52] U.S. Cl. ..... 126/362

[58] Field of Search ..... 126/362, 419, 437; 219/297

[56] References Cited

U.S. PATENT DOCUMENTS

| | | | |
|---|---|---|---|
| 1,109,946 | 9/1914 | Stack . | |
| 1,913,622 | 6/1933 | Williams . | |
| 2,591,400 | 4/1952 | Burklin | 126/362 |
| 2,660,163 | 11/1953 | Whitney et al. . | |
| 3,575,157 | 4/1971 | Whittel . | |
| 3,705,574 | 12/1972 | Duncan | 126/362 |
| 4,680,444 | 7/1987 | Post . | |

*Primary Examiner*—Carroll B. Dority

*Attorney, Agent, or Firm*—Dennison, Meserole, Pollack & Scheiner

[57] ABSTRACT

A system is described for supplying water heated to a desired temperature range to a facility having a demand for the heated water varying widely between a normal flow rate and a peak flow rate. The system includes a water heater having an output capable of supplying water heated to the desired temperature at the normal flow rate, and a storage tank for storing additional water heated to the desired temperature. Under conditons of normal flow rate, unheated water is supplied directly to the water heater with no flow to the tank. When the flow increases above the normal flow rate, unheated water is supplied to the tank, and heated water is withdrawn from the tank and cold water is simultaneously supplied to the water heater. The flow between the tank and the water heater is limited to the capacity of the heater to supply water at the desired temperature, and the excess demand is supplied by heated water within the tank. After the flow rate returns to normal, water continues to pass from the tank to the heater and is recycled to the tank until such time as the water in the tank is at the desired temperature. At that time, unheated water again bypasses the tank and flows directly to the heater.

15 Claims, 2 Drawing Sheets

Fig. 1.
(PRIOR ART)
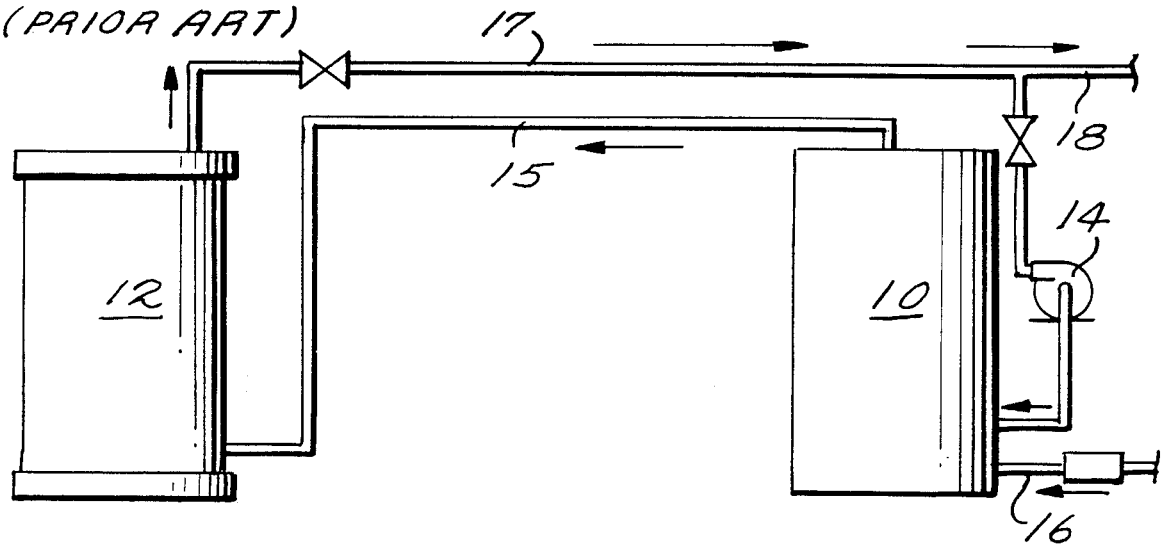
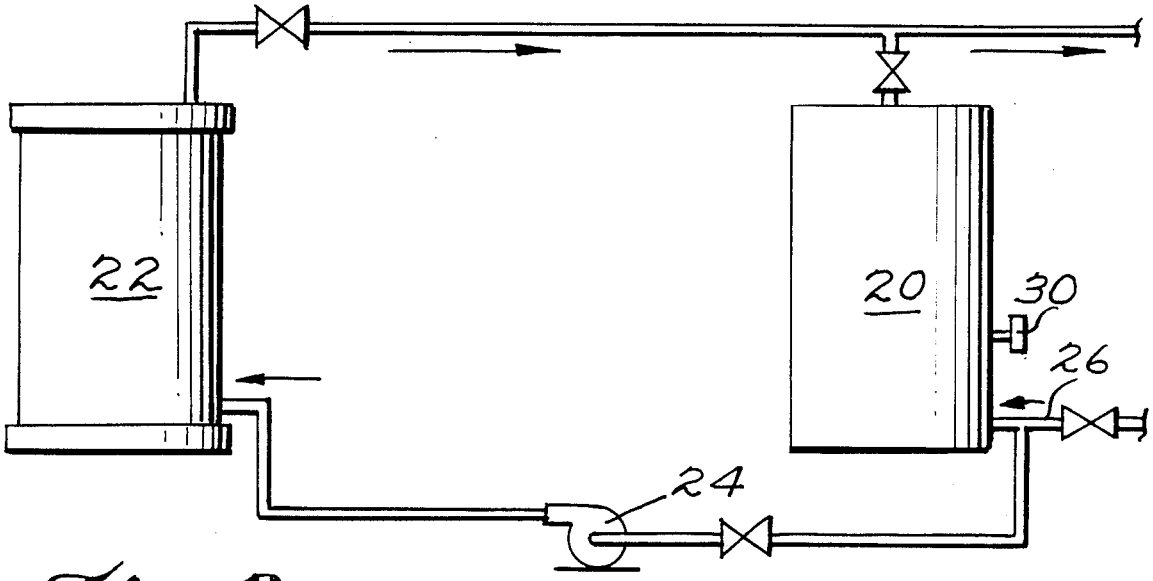
Fig. 2.
(PRIOR ART)
Fig. 4b.
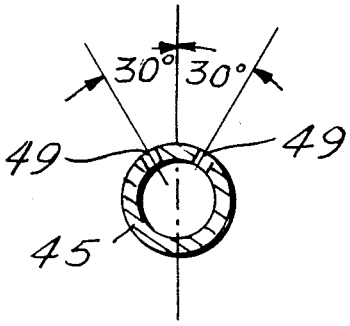
Fig. 4a.
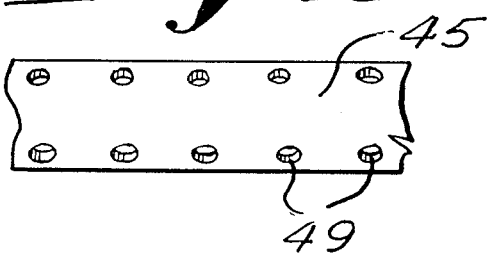

50
60
40
45
62
68
57
46
66
56
44
52
63
41
54
55
47
42

80
69
67
75
88
73
78
76
74
79
77
90
89a
87a
71
72a
77a
86a
82a
83a
71a
82b
83b
77b
86b
87b
89b
72b
71b

HOT WATER HEATING SYSTEM WITH SELECTIVE BYPASS

This application is a continuation-in-part of application Ser. No. 377,093, filed Jul. 10, 1989 and now abandoned.

BACKGROUND OF THE INVENTION

The invention relates to the field of institutional hot water heating systems, as would be used in public schools, hospitals, health care centers, spas, nursing homes, hotels, motels, prisons and industry. Institutional hot water systems are distinguished in that there is both a diversified hot water demand and a brief high peak hot water demand. The diversified load means that there are a number of appliances requiring hot water, including sinks, showers, tubs, and dishwashers used periodically. High peak demand appliances include gang showers, commercial washers, whirlpools and therapy tubs.

For many years, hot water was supplied to institutions in the same manner it was supplied for home use that is by a single storage tank with internal heaters having low efficiencies (70% at best). For institutional use, however the storage tank needed to be scaled up to a very large size capable of handling peak demand. This type of system was quite inefficient, as it required keeping a large quantity of water hot during long periods with little demand.

In the late 1940s, two other methods of supplying institutional hot water were developed, the instantaneous heater and the semi-instantaneous heater.

The instantaneous heating system required the same large storage tank with a closed loop recirculation system between the heater and tank in order to maintain proper temperature control.

The semi-instantaneous heater had excellent temperature control without the use of storage, but had to be sized to handle the highest peak demand of the system, even when that peak demand might last for only 10 or 15 minutes per hour. Often, large stratified tanks or accumulator tanks were used in conjunction with semi-instantaneous heaters to solve the high periodic demand load.

As an example, a high school uses between 0 and 25 gallons per minute of 110° F. water in its diversified load, sinks, lavatories and cafeterias, and has a high peak demand load of 40 gpm gang showers that operate 10 minutes every hour. If the diversified load averages 60% of the diversified load capacity during class hours, the total draw per hour will be 60%×25 gpm×60 min.=900 gallons per hour, plus the peak load 10 min.×40 gpm=400 gallons per hour for the showers. The total usage will be 1300 gph.

If this load were to be handled with a traditional storage tank installation, that tank would be sized at a minimum of 2000 gallons holding capacity and a 1500 gph recovery rate with an efficiency of 70% at best. If an instantaneous or semi-instantaneous heater were used in the above installation, it would require at least a 1,000,000 BTU per hour heater to furnish the required 1500 gallons per hour hot water with a closed loop recirculation pump to keep the 2000 gallons of water in the tank hot.

Typical prior art institutional heating systems are shown in FIGS. 1 and 2. In FIG. 1, cold water enters the bottom of accumulator 10 and passes to heater 12 from which it passes to the demand appliances or is recirculated back to the bottom of the accumulator. Circulation pump 14 must run continuously to keep the tank water hot. This is the least effective method of providing sufficient hot water because the total flow must pass into the bottom of the tank forcing its stored hot water through the heater. For this reason, the heater does not begin to function until most of the hot water in the accumulator tank is used and cold water enters the heater from the tank. Heating time is therefore lost while the tank is emptying and the heater is idling until it senses cold water.

In FIG. 2, a stratified hot water storage tank 20 is utilized. The cold water supply 26 enters the hot water tank at the bottom, and the hot water output of the system 28 is taken directly from the top of the storage tank. A temperature sensor is provided in the bottom of storage tank 20, and when the sensor determines that cold water is entering the tank due to utilization of hot water, pump 24 is activated to supply cold water to heater 22. The output of heater 22 is then combined with the output of the storage tank.

The system shown in FIG. 2 works well when there is a high draw on the system at or above the heater capacity. If the heater can produce 27 gpm of 110° F. water, and the load requirements are 27 gpm or greater, the pump will run continuously; the heater will operate at full capacity and only the hot water demand above 27 gpm will actually be depleted from the tank. Thus, in the heavy load situation both tank and heater operate at their best combined effectiveness.

A problem arises with the system of FIG. 2 when the demand drops below 27 gpm, which is 50 minutes of every hour during class days, plus nights holidays and weekends. During that time when there is normal demand, whenever a faucet is opened or dishwasher runs, the temperature sensor in the tank will feel cold water and activate the pump. Since 27 gpm circulates through the heater, as little as 10 gpm may go to the faucets while 17 gpm of heated water returns to the tank. This heated water will be sensed by the temperature sensor, and shut off the pump in as little as a minute or two. If the 10 gpm draw continues, the pump and heater could cycle on and off 15 or more times per hour. Such cycling wastes electricity and causes premature pump failure.

In order to solve this problem, a baffle may be installed in the bottom of the storage tank so that the electric sensor does not feel cold water until 30 to 40% of the reserve water is drawn off from the tank. While this solves the problem of the pump cycling on and off, it creates another problem since the tank must be sized 30 to 40% larger to compensate.

Another approach to the problem of supplying hot water over a wide range of demand is disclosed in U.S. Pat. Nos. 3,668,839 and 3,766,974. These patents disclose a hot water storage tank with a cold water supply, an internal heater, and a continuously operating pump to cycle tank water through the heater. Under high demand conditions, hotter tank water is drawn from the upper part of the tank to increase the capacity of the heater.

U.S. Pat. No. 3,705,574 discloses a hot water heating system with separate heater and storage tank. Circulation of water between the heater and tank is controlled by a thermostatic mixing valve which admits cold water when the water passing through the valve exceeds a predetermined temperature.

SUMMARY OF THE INVENTION

It is a first object of the invention to provide a hot water heating system of greater efficiency and minimum component size.

It is a further object of the invention to provide a hot water heating system which minimizes pump usage and cycling.

It is another object of the invention to provide a hot water heating system which minimizes draw of water from a storage tank and maximizes draw of water directly from a heater.

To achieve these and other objects the present invention provides a system for supplying water heated to a desired temperature range to a facility having a demand for the heated water varying widely between a normal flow rate and a peak flow rate, comprising: a water heating means having a capacity for heating unheated water to the desired temperature range at a rate at least equal to and generally greater than the normal flow rate; means for supplying unheated water to the system; a storage tank for containing a predetermined volume of water heated approximately to the desired temperature range; means for supplying unheated water directly to the heater when the demand for water is no greater than the capacity of said heating means; means for supplying unheated water directly to the storage tank when the demand for water exceeds the capacity of the heating means; means for transferring water from the storage tank to the heating means when the temperature of water in the storage tank falls below the desired temperature range; means for supplying heated water to the facility from the heating means when the demand is not in excess of the capacity and from the heating means and storage tank when the demand exceeds the capacity; and means for transferring water from the tank to the heating means and back to the tank means in order to maintain the water in the tank in the desired temperature range.

The system of the invention operates on the basis that cold water is diverted from the storage tank directly to the heater in times of normal water usage. Only in times of peak demand will water directly enter the storage tank. The diversion of water directly to the heater can be accomplished in a number of ways, generally involving the use of a throttling valve at the input or the output of the heater to indicate excess flow. In a preferred embodiment a weight and lever check valve with adjustable cracking is placed between the cold water supply and the input to the storage tank, and when the cold water flow to the heater is excessive, excess pressure building up in the cold water supply line will open the weight and lever check valve allowing cold water to flow to the storage tank.

In another embodiment, the weight and lever check valve is replaced by a pneumatic or electric automatic control valve which admits water to the storage tank only when there is excess flow in the cold water supply line to the heating means. This control valve is shut off by the tank sensor when tank temperature is satisfied and power is cut off.

The water heater preferred for use in the system of the invention is a heater of the semi-instantaneous type, due to its excellent temperature control in the range of ±4° F. However, other water heaters having good temperature control and adequate heating rates may also be used.

BRIEF DESCRIPTION OF THE DRAWINGS

FIG. 1 is a schematic view of a first prior art hot water heating system;

FIG. 2 is a schematic drawing of a second prior art hot water heating system;

FIG. 4*a* is a top perspective view of a dispersion tube used in the embodiment of FIG. 3;

FIG. 4*b* is an end view in cross section of the dispersion tube shown in FIG. 4*a;*

DESCRIPTION OF THE PREFERRED EMBODIMENTS

Figures 3, 5:
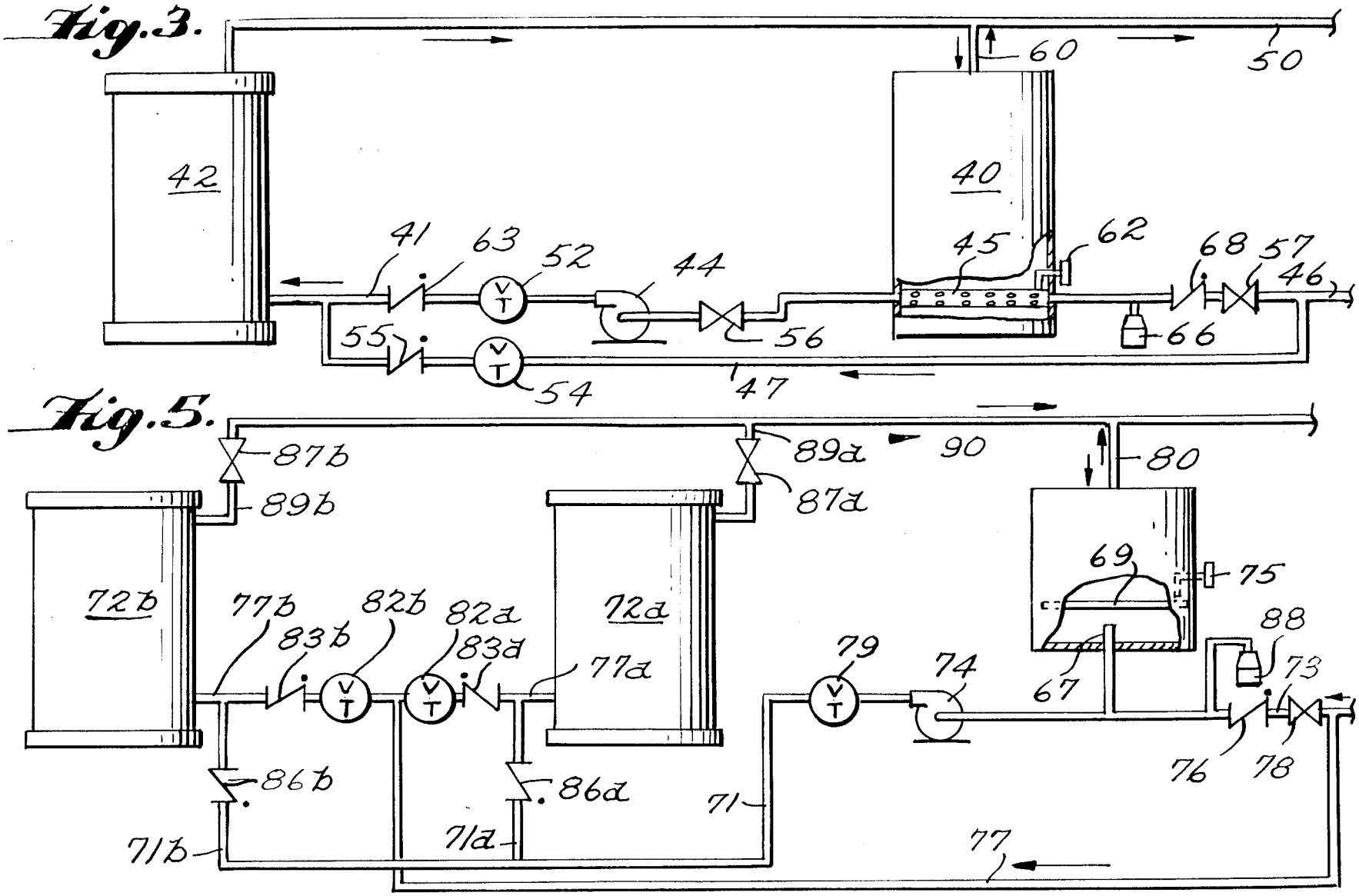
FIG. 3 is a schematic drawing of an embodiment of the hot water heating system according to the invention.
FIG. 5 is a schematic drawing of a second embodiment of the hot water heating system according to the invention.

A first embodiment of the hot water heating system of the invention is shown in FIG. 3. The embodiment of FIG. 3 utilizes a storage tank 40 and a semi-instantaneous hot water heater 42 capable of producing 28 gpm at a 65° F. rise in temperature. Cold water is supplied to the system by a line 46 passing directly to the bottom of hot water heater 42 by way of bypass conduit 47, including a throttling valve 54 and a check valve 55. The capacity of throttling valve 54 is set to the capacity of heater 42, 28 gpm. Cold water is also passed to the bottom of storage tank 40 by means of a shut-off valve 57 and a weight and lever check valve 68, with adjustable cracking pressure The weight and lever check valve used to regulate entry of water into the tank is a commercially available device in which cracking pressure is set by adjusting the position of a weight on a lever arm. Depending on the desired cracking pressure, it may be necessary to modify the valve by extension of the lever arm and/or use of a heavier weight. An expansion tank 66 is provided at the input of the storage tank 40, but may also be placed at the outlet.

Water entering storage tank 40 passes through a dispersion tube 45 which will be further described. At the exit of the dispersion tube is a transfer conduit 41 passing to the bottom of the hot water heater 42 by means of an isolation valve 56, a pump 44, a throttling valve 52 and a check valve 63. The pump utilized is generally a centrifugal pump which maintains an approximate predetermined measured flow. In this case, pump 44 is set to deliver water at the capacity of heater 42, at least 28 gpm, and throttling valve 52 is also set to the capacity of the heater 42. Hot water output line 50 connected to the facility to be served is taken directly from the top of hot water heater 42, and a reversible flow conduit 60 is connected between the top of hot water tank 40 and the hot water output line 50.

As shown in FIGS. 4*a* and 4*b*, the dispersion tube 45 includes a series of holes 49 directed generally upwardly and placed at an angle 30° from the vertical.

In an alternative embodiment, the dispersion tube can be eliminated, and a baffle placed near the inlet of the tank.

By way of example, the system shown in FIG. 3 is used to supply hot water to a 120 bed nursing home with 50° F. inlet water and 110° F. outlet water at the faucets. The peak draw is 50 gpm, 10 minutes each half hour, while the normal draw 10 hours a day is 12 gpm. Because of losses in the conduits between the heating system and the faucets, the temperature of the hot water heater is set at 115° F. The heater uses a gas fired semi-instantaneous water heater capable of producing 28 gpm at a 65° rise in temperature, and one tank is used for this application.

When a normal load of 12 gpm is in effect with low peaks up to 25 gpm, supply water from a municipal cold water source under a given supply of pressure will flow through bypass conduit 47 through the throttling valve 54 and will be heated by heater 42. Hot water from the heater directed through line 50 will serve the faucets.

When flow through conduit 47 approaches 28 gpm, back pressure will be created by throttling valve 54 and will force supply water through weight and lever check valve 68 into tank 40 through the dispersion tube 45. Temperature sensor 62 located above the dispersion tube will activate pump 44, which will draw 28 gpm of mainly cold water from dispersion tube 45, and send it through throttling valve 52 to heater 42. Check valve 55 will close, shutting off the bypass conduit.

As the load rises, 28 gpm will continue to flow through the dispersion tube 45 directly to heater 42. However, back pressure created by throttling valve 52 will force cold water from dispersion tube 45 into tank 40, thereby forcing hot water to the top of the storage tank and through conduit 60 to hot water outlet 50. At the peak load of 50 gpm, 28 gpm will be supplied by the heater and 22 gpm will be supplied from the top of storage tank 40.

The 50 gpm load continues for 10 minutes, depleting 220 gallons of water from the storage tank. At that time, the load drops to an average of 12 gpm, but check valve 55 remains closed, causing water to be directed to the storage tank. The pump continues to operate to supply the heater with 28 gpm from the dispersion tube, including some cold water from tank 40, and with the 12 gpm load being drawn off through conduit 50. The excess 16 gpm flowing from the heater will recirculate down to the storage tank through conduit 60 until such time as the water in the storage tank returns to 115° F., and the sensor 62 shuts off the pump. At that time, back pressure in the weight and lever check valve 68 immediately diverts cold water through bypass 47 directly to hot water heater 42. Once again, no water flows directly to the storage tank and the entire system operates on water passing directly to the heater.

If radiation losses cause the temperature in the storage tank to drop below 115° F., the pump will once again be activated, and water will be circulated between the storage tank and the heater until such time as the temperature in the storage tank returns to 115° F. If there is no demand on the system at that point, no cold water from the water source will enter the storage tank, and 28 gpm will circulate between the tank and the heater.

With this system, the storage tank can be sized according to the total draw, exceeding heater capacity, during the period of peak flow. Therefore, the minimum tank size would be 220 gallons although some extra capacity would be preferred; a 300 gallon tank would be suitable.

A variation of the system of the invention is shown in FIG. 5. In FIG. 5, the weight and lever check valve 68 has been replaced by an electric or pneumatic automatic control valve 76 in supply conduit 73 at inlet 67, which is at the bottom of storage tank 70. A shut-off valve 78 is also provided at the input to tank 70 as well as an expansion tank 88. Sensor 75 senses water temperature in the tank. The dispersion tube has been eliminated, and a baffle 69 has been located in the tank, directly above the inlet.

The single heater of the system shown in FIG. 3 has been replaced by a pair of heaters, **72*a* and 72*b* in parallel. Bypass 77 feeds to conduits 77*a* and 77*b* at the inputs to the heaters, with conduit 77*a* including a throttling valve 82*a* and check valve 83*a* and conduit 77*b* including a throttling valve 82*b* and check valve 83*b*. A transfer conduit 71 is provided from the bottom outlet of the storage tank 70, conduit 71 including pump 74 and throttling valve 79. Conduit 71 is also connected in parallel to the inputs of the heaters via conduits 71*a* and 71*b*, each of the conduits including a check valve 86*a* or 86*b*. The outlets from the heaters 89*a* and 89*b* are connected to system output conduit 90 conduit 89*a* including a valve 87*a*, and conduit 89*b* including a valve 87*b*. Conduit 80 from the top of the storage tank is connected to system output conduit 90**.

This system is advantageous in that one of the heaters can be shut off when system demand is especially low, such as on weekends, and both heaters can be activated when demand is between normal and peak.

As an example, the system shown in FIG. 5 is used in the high school with a normal diversified load of between 0 and 25 gpm of 110° F. water, and 2 sets of 40 gpm gang showers that operate 10 minutes of every hour during classes. With the diversified load at 60% capacity during class hours, the normal load will be 900 gph and the peak load will be 1700 gph.

In this system, the control valve 76 is set between 3 and 7 psi opening pressure. If the initial draw is 10 gpm, cold water will attempt to enter the bottom of tank 70, but because of the resistance of control valve 76, will flow directly through bypass 77 to heaters **72*a* and 72*b* through check valves 83*a* and 83*b* which are set to admit water at much lower pressures. Heaters 72*a* and 72*b* each produce up to 28 gpm of 110° F. water, and throttling valves 82*a* and 82*b*** are accordingly each set to admit 28 gpm. Under a normal load of up to 25 gpm, each heater need produce no more than 12.5 gpm hot water.

With the diversified load operating at 60% capacity, or 15 gpm, the gang showers are turned on, producing a total peak load of 95 gpm. Since throttling valves **82*a* and 82*b* are set at only 28 gpm each, excess pressure builds in line 77, causing flow through control valve 76 into storage tank 70. Temperature sensor 75 senses a drop in temperature of water in the storage tank and activates pump 74 which pumps 56 gpm water from tank 70 and the cold water inlet to heaters 72*a* and 72*b*. This causes a drop in water pressure in bypass 77, causing check valves 83*a* and 83*b*** to close, shutting off water from the bypass to the heaters.

Water from the pump passes through throttling valve 79, which is set to admit 56 gpm, the maximum capacity of the combined heaters. The water pressure in line 71 then opens check valves **86*a* and 86*b* causing water flow from the pump to pass directly to heaters 72*a* and 72*b*. Since the demand on the system is 95 gpm, and the maximum water flow through line 71 is 56 gpm, pressure builds behind the throttling valve 79 in tank 70, causing the excess 39 gpm to flow through line 80** to the faucets.

If the 95 gpm flow continues for 10 minutes, and the total capacity of the heaters is 56 gpm, then 39 gpm will be withdrawn from the tank, for a total of 390 gallons over the peak period. Thus, a tank sized in the range of 450 to 500 gallons should provide sufficient excess capacity under normal conditions. This can be compared with a 3000 gallon tank, which would normally be required in a system with these demands.

When the showers are turned off, and the diversified load drops to 15 gpm, the heaters are still producing 56 gpm because the pump continues to operate until the tank is filled with 110° F. water. While 15 gpm continue to go to the faucet, the remaining capacity of the heaters, 41 gpm, is flowing through line 80 to replenish heated tank water. It will take less than 10 minutes to replace the hot water withdrawn from the tank during the operation of the showers. When the tank is filled with 110° F. water, sensor 75 shuts off pump 74 and closes control valve 76, and the pump will remain off for a period of approximately 40 minutes, until the showers are reactivated. For nights, weekends, and holidays, when total demand on the system should be no more than 10 gpm, valve 82*b* can be closed completely, shutting off all water to heater 72*b*. Moreover, valve 78 can be closed and pump 74 deactivated since no water will be withdrawn from the tank during these periods.

By using the selective bypass of the invention in institutional applications utilizing a separate heater and storage tank, the tank size can be reduced by as much as 80%, and space requirements reduced by more than 70%. By operating the pump for only short periods with no cycling, the pump life is prolonged and the maintenance cost reduced. The heater size can also be minimized. In the embodiments of the invention, the throttling valves used to control maximum flow in the lines can be replaced by an adjustable flow switch and programmable controller. Other embodiments will become evident to those of ordinary skill in the art.

What is claimed is:

1. A system for supplying water heated to a desired temperature range to a facility having a demand for the heated water varying widely between a normal flow rate and a peak flow rate, comprising:

(a) a water heating means having a capacity for heating unheated water to the desired temperature range at a rate at least equal to the normal flow rate, and having an inlet and an outlet;

(b) unheated water supply means for connection to a source of unheated water;

(c) bypass conduit means connecting said unheated water supply means to said heating means inlet and including a means limiting water flow in said bypass means to a predetermined rate no greater than approximately the capacity for heating of said water heating means;

(d) a storage tank for containing a predetermined volume of water heated approximately to the desired temperature range, and having an inlet and an outlet in the lower portion thereof and a further port in the upper portion thereof, and a means for measuring the temperature of water therein;

(e) supply conduit means connecting said storage tank inlet to said unheated water supply means, and including means for interrupting the flow of water therethrough when the flow of water therein is less than a predetermined value;

(f) transfer conduit means connecting said tank outlet and said heating means inlet, and including means for pumping water from said tank outlet to said heating means inlet, and means for regulating flow therethrough at approximately the capacity for heating of said water heating means;

(g) means activating said pumping means when the temperature measured by said sensor falls below a predetermined temperature;

(h) means interrupting water flow in said bypass conduit means when said pumping means is activated;

(i) means interrupting the flow of water in said transfer conduit means when said pumping means is not activated;

(j) heated water supply means for connection between said heating means outlet and the facility; and (k) recycle conduit means connected between said heated water supply means and said further tank port.

2. A system according to claim 1, wherein said means for interrupting the flow of water through said supply conduit means comprises a weight and lever check valve with an adjustable cracking pressure.

3. A system according to claim 1, wherein said means for interrupting the flow of water through said supply conduit means comprises an electric or pneumatic automatic control valve.

4. A system according to claim 1, wherein said means for limiting water flow in said bypass means comprises a throttling valve.

5. A system according to claim 1, wherein said means for regulating the flow of water through said transfer conduit means comprises a throttling valve.

6. A system according to claim 1, wherein said water heating means comprises at least two water heaters connected in parallel, each including a bypass conduit means communicating with the input thereof.

7. A system according to claim 1, wherein said water heating means comprises a semi-instantaneous water heater.

8. A system according to claim 1, wherein said means interrupting water flow in said bypass conduit means comprises a check valve.

9. A system according to claim 1, wherein said means interrupting water flow in said transfer conduit means comprises a check valve.

10. A system according to claim 1, wherein said means limiting water flow in said bypass means comprises an adjustable flow switch and programmable controller therefor.

11. A system according to claim 1, wherein said means limiting flow through said transfer conduit means comprises an adjustable flow switch and programmable controller therefor.

12. A system according to claim 1, additionally comprising a dispersion conduit connecting between said tank inlet and said tank outlet internally of said tank, and including a plurality of flow holes communicating between the interior of the dispersion conduit and the interior of the tank.

13. A system according to claim 12, wherein said flow holes are directed upwardly at an angle of approximately 30° from the vertical.

14. A system according to claim 1, wherein said supply conduit means includes means for visually observing the flow of water therethrough.

15. A system for supplying water heated to a desired temperature range to a facility having a demand for the heated water varying widely between a normal flow rate and a peak flow rate, comprising:

(a) a water heating means having a capacity for heating unheated water to the desired temperature range at a rate at least equal to the normal flow rate;

(b) means for supplying unheated water to said system;

(c) storage tank means for containing a predetermined volume of water heated approximately to the desired temperature range;

(d) means for supplying unheated water directly to said heating means when the demand for water is no greater than the capacity of said heating means;

(e) means for supplying unheated water directly to said storage tank means when the demand for water exceeds the capacity of said heating means;

(f) means for transferring water from said storage tank means to said heating means when the temperature of water in said storage tank means falls below the desired temperature range;

(g) means for supplying heated water to the facility from said heating means when the demand is not in excess of the capacity of said heating means, and from the heating means and storage tank means when the demand exceeds the capacity of said heating means; and (h) means for transferring water from said tank means to said heating a means and back to said tank means in order to maintain the water in said tank means in the desired temperature range.

* * * * *